US009671113B2

(12) United States Patent
Hasegawa

(10) Patent No.: US 9,671,113 B2
(45) Date of Patent: Jun. 6, 2017

(54) GAS RANGE

(71) Applicant: Tom Hiroshi Hasegawa, Gardena, CA (US)

(72) Inventor: Tom Hiroshi Hasegawa, Gardena, CA (US)

( * ) Notice: Subject to any disclaimer, the term of this patent is extended or adjusted under 35 U.S.C. 154(b) by 480 days.

(21) Appl. No.: 14/229,653

(22) Filed: Mar. 28, 2014

(65) Prior Publication Data

US 2015/0276231 A1 Oct. 1, 2015

(51) Int. Cl.

| | |
|---|---|
| ***F24C 3/12*** | (2006.01) |
| ***F23N 1/00*** | (2006.01) |
| ***F23N 5/24*** | (2006.01) |

(52) U.S. Cl.

CPC ..... *F24C 3/126* (2013.01); *F23N 1/005* (2013.01); *F23N 5/245* (2013.01); *F23N 2035/14* (2013.01); *F23N 2035/18* (2013.01); *F23N 2037/10* (2013.01); *F23N 2041/08* (2013.01)

(58) Field of Classification Search

CPC .. F23N 1/005; F23N 2035/14; F23N 2035/18; F23N 2037/10; F23N 2900/05101; F23N 2041/08; F23N 5/245; F24C 3/126

See application file for complete search history.

(56) References Cited

U.S. PATENT DOCUMENTS

| | | | | |
|---|---|---|---|---|
| 3,123,298 A * | 3/1964 | Wolffe | F16K 31/485 | 236/1 E |
| 4,543,974 A * | 10/1985 | Dietiker | F23N 5/105 | 137/66 |
| 4,602,610 A * | 7/1986 | McGinnis | F23N 1/005 | 126/110 E |
| 4,850,530 A * | 7/1989 | Uecker | F23N 5/105 | 137/110 |
| 5,035,607 A * | 7/1991 | Peterson | F23N 5/203 | 431/24 |
| 5,785,511 A * | 7/1998 | Shah | F23N 1/005 | 137/65 |

FOREIGN PATENT DOCUMENTS

| | | |
|---|---|---|
| JP | 09201277 A * | 8/1997 |
| KR | 20-0326246 | 9/2003 |

* cited by examiner

*Primary Examiner* — Steven B McAllister
*Assistant Examiner* — Steven Anderson, II
(74) *Attorney, Agent, or Firm* — Norton Rose Fulbright US LLP

(57) ABSTRACT

A gas range including a main valve and an auxiliary valve, providing a weak fire power by blocking some of gas flow paths, when a cooking container reaches a setting temperature, by the auxiliary valve so as to let the rice stand after cooking or simmer the ingredients to prepare stock for a long time, and blocking gas supply by closing the main valve when the cooking container becomes in an overheated state so as to prevent an accident by overheat.

6 Claims, 6 Drawing Sheets

GAS RANGE

BACKGROUND OF THE INVENTION

1. Field of the Invention

The present invention relates to a gas range, and more particularly, to a gas range, which can cook rice, make soup, let the rice stand after cooking, or simmer the ingredients to prepare stock for a long time.

2. Background Art

In general, when people cook a lot of rice or soup in various restaurants or large-scale facilities for food service, they cook as soon as possible using a strong fire power and let the rice stand using remaining heat after cooking As shown in FIG. 1, such a conventional gas range includes: an operation lever 1; a cooking lever 2; an opening valve 3 being opened in interlock with the cooking lever 2 by a manipulation of the operation lever 1 so as to supply gas; a magnetic temperature sensor 4 for sensing temperature of a cooking container; and a magnet 5 mounted on the cooking lever 2 corresponding to the magnetic temperature sensor 4, wherein the cooking lever 2 is lifted by the magnet 5 and the opening valve 3 is lifted by the cooking lever 2 so that gas is continuously supplied in a state where the cooking lever 2 and the opening valve 3 keep the lifted state.

Moreover, when the cooking container reaches a predetermined temperature, the magnetic temperature sensor 4 and the magnet 5 which are stuck to each other by a magnetic force are separated from each other, and hence, the cooking lever 2 and the opening valve 3 return to their original positions, so that supply of gas is stopped.

That is, the conventional gas range can cook quickly with the strong fire power, automatically stop supply of gas by setting temperature, and keep rice warm by the remaining heat.

As similar technology, there is Korean Utility Model Application No. 20-2003-0020025 which has been filed in advance.

SUMMARY OF THE INVENTION

Accordingly, the present invention has been made to solve the above-mentioned problems occurring in the prior arts, and it is an object of the present invention to provide a gas range (or gas stove), which can cook, with any type cooking devises including a pressure cooker, stock pot, etc., as soon as possible using a strong fire power when people want to cook food in factories or restaurants, which can block a part of a gas flow path to provide a weak fire power when the setting temperature is sensed, so as to let the rice stand after cooking or cook food, and which can automatically prevent gas supply when the gas range overheat the cooking container beyond the setting temperature or when setting time passes.

To achieve the above objects, the present invention provides a gas range used for cooking including:

a housing mounted inside a gas range case and having a gas flow path which includes an inflow path, an outflow path, first and second connection paths for connecting the inflow path and the outflow path with each other, and an auxiliary flow path;

an operation lever mounted on the front face of the case, actuating a main valve and an auxiliary valve in order to supply gas through the gas flow path for cooking, the operation lever being adapted to ignite spark through a burner valve and an ignition device;

a main valve having, a first pin moving according to the operation of the operation lever and returning to its original position by a first spring, a first opening valve moving according to the movement of the first pin and returning to its original position by a second spring, a first cutoff plate mounted for opening and closing the inflow path according to the movement of the first opening valve, a first thermoelectric couple mounted near to flame for generating an electromotive force by the flame, and a first magnet being magnetized by a first coil which receives the electromotive force generated by the first thermoelectric couple and fixing the first opening valve moving upwardly;

an auxiliary valve having a second pin moving according to the operation of the operation lever and returning to its original position by a third spring, a second opening valve moving according to the movement of the second pin and returning to its original position by a fourth spring, a second cutoff plate mounted for opening and closing the first connection path according to the sliding of the second opening valve, a second thermoelectric couple mounted near to flame for generating an electromotive force by the flame, and a second magnet being magnetized by a second coil which receives the electromotive force generated by the second thermoelectric couple and fixing the second opening valve moving upwardly;

a timer operating the main valve to close the inflow path after a lapse of setting time;

the burner valve opening the auxiliary flow path so as to supply gas when the main valve moves to open the gas flow path and returning to its original position by a fifth spring; and the ignition device adapted to generate ignition spark when the burner valve is opened to supply gas.

Moreover, the main valve further comprises a first thermostat disposed between the first thermoelectric couple and the first coil, the first thermostat intercepting an electromotive force when the cooking container reaches 150° C., so that the main valve returns to its original position in order to prevent gas supply.

Furthermore, the auxiliary valve further comprises a second thermostat disposed between the second thermoelectric couple and the second coil, the second thermostat intercepting an electromotive force when the cooking container reaches above 100° C., for instance, 105° C., so that the auxiliary valve returns to its original position in order to prevent gas supply through the first connection path and less than 100 percent of gas, for instance, just 20 percent to 30 percent of gas, is supplied through the second connection path.

Additionally, the gas range further includes: a third connection path disposed between the inflow path and the outflow path; and a selection valve for opening or closing the third connection path by the user's manipulation.

In addition, the selection valve includes: a manipulation bar for allowing the user to manipulate with the hand; a third cutoff plate mounted for opening and closing the third connection path by the user's manipulation of the manipulation bar; and a sixth spring mounted on the upper portion of the third cutoff plate for returning the cutoff plate to its original position.

As described above, the gas range according to the present invention can be used for a period of time set by a timer.

Moreover, the gas range according to the present invention can supply a weak fire power by returning the auxiliary valve to its original position when it reaches the temperature set by the first and second thermostats so as to let the rice stand after cooking or to simmer the ingredients to prepare stock for a long time, and can prevent gas supply by returning the main vale to its original position at the time of overheat beyond the setting temperature so as to provide a fire power of a second pattern to prevent an accident.

Furthermore, the gas range according to the present invention can provide 100 percent of fire power manually Additionally, the gas range according to the present invention can provide less than 100 percent, for instance, 20 percent to 30 percent of fire power manually because it includes the press button and the ON-OFF switch.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
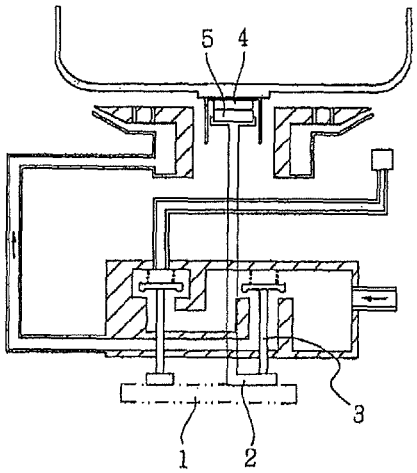
FIG. 1 PRIOR ART
FIG. 1 is a schematic diagram of a conventional gas range.
Figure 2:
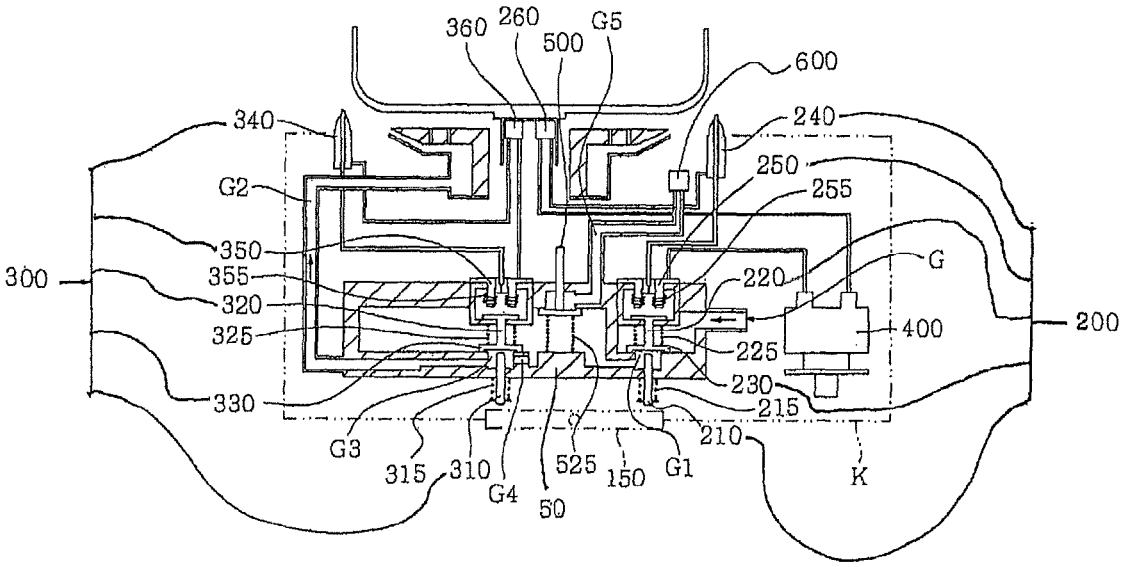
FIG. 2 is a schematic diagram of a gas range according to the present invention.
Figure 3:
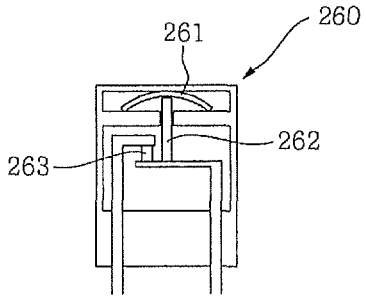
FIG. 3 is a sectional view of a first thermostat of the gas range according to the present invention.
Figure 4:
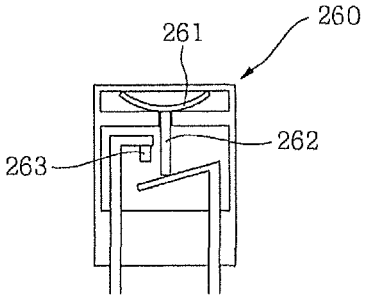
FIG. 4 is a sectional view showing an operational state of FIG. 3.
Figure 5:
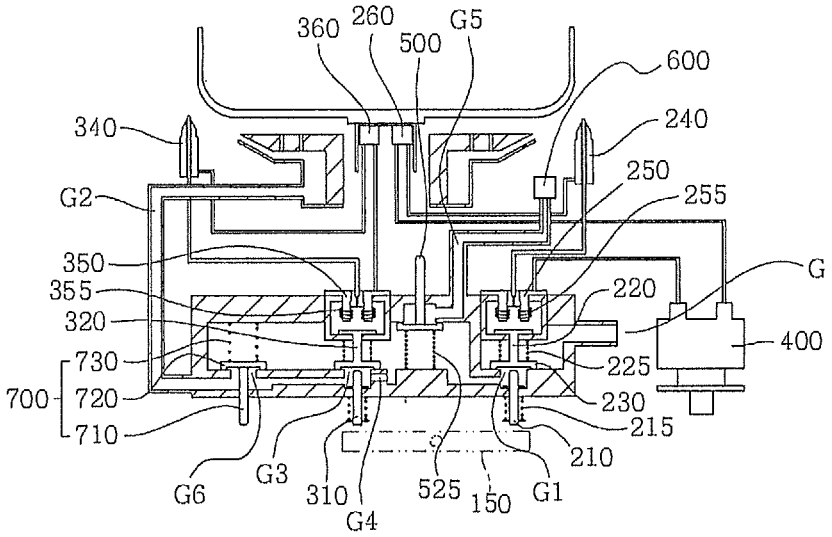
FIG. 5 is a schematic diagram showing a state where a selection valve is mounted on the gas range of FIG. 2.
Figure 6:
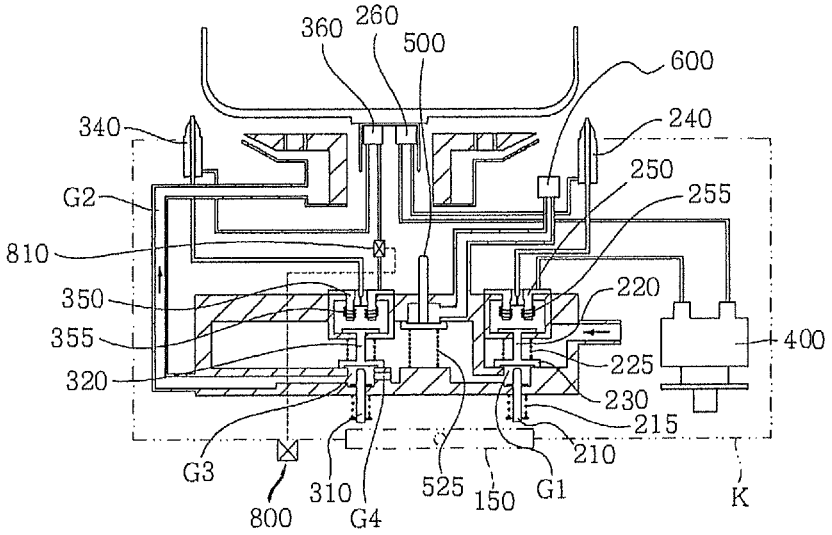
FIG. 6 is a schematic diagram showing a state where a press button and an ON-OFF switch are mounted on the gas range of FIG. 2.

FIG. 2 is a schematic diagram of a gas range according to the present invention, FIG. 3 is sectional view of a first thermostat of the gas range according to the present invention, FIG. 4 is a sectional view showing an operational state of FIG. 3, FIG. 5 is a schematic diagram showing a state where a selection valve is mounted on the gas range of FIG. 2, FIG. 6 is a schematic diagram showing a state where a press button and an ON-OFF switch are mounted on the gas range of FIG. 2, and FIGS. 7 to 11 are schematic diagrams showing an operational state of the gas range according to the present invention.

First, in the drawings, the same components have the same reference numerals even though they are illustrated in different figures. In addition, in the description of the present invention, when it is judged that detailed descriptions of known functions or structures related with the present invention may make the essential points vague, the detailed descriptions of the known functions or structures will be omitted.

As shown in FIG. 2, a gas range according to the present invention includes a housing 50 having a gas flow path G, an operation lever 150, a main valve 200, an auxiliary valve 300, a timer 400, a burner valve 500, and an ignition device 600.

The housing 50 is mounted inside a gas range case K, and has the gas flow path formed therein.

The gas flow path includes: an inflow path G1 for introducing gas, an outflow path G2 for discharging gas, first and second connection paths G3 and G4 for connecting the inflow path G1 and the outflow path G2 with each other; and an auxiliary path G5.

The first connection path G3 is opened or closed by the auxiliary valve 300 which will be described later. That is, when the first connection path G3 is opened, 100 percent of gas is supplied through the first and second connection paths G3 and G4, and when the first connection path G3 is closed, less than 100 percent of gas, for instance, 20 percent to 30 percent of gas is supplied through the second connection path G4.

The auxiliary path G5 has one end connected with the inflow path G1 and the other end mounted near to the ignition device 600 which will be described later, so as to supply gas to the ignition device 600.

The operation lever 150 is mounted on the front face of the gas range case K, and when a user presses or rotates the operation lever 150, it operates to open the main valve 200 and the auxiliary valve 300 so as to supply gas through the gas flow path G and operates the burner valve 500 and the ignition device 600 so as to ignite spark.

The main valve 200 includes: a first pin 210 upwardly sliding according to the operation of the operation lever 150 and returning to its original position by a first spring 215; a first opening valve 220 upwardly sliding according to the upward movement of the first pin 210 and returning to its original position by a second spring 225; a first cutoff plate 230 mounted for opening and closing the inflow path G1 according to the upward sliding of the first opening valve 220; a first thermoelectric couple 240 mounted near to flame generated by the ignition device 600 for generating an electromotive force by the flame; and a first magnet 250 being magnetized by a first coil 255 which receives the electromotive force generated by the first thermoelectric couple 240 and fixing the first opening valve 220 moving upwardly.

In other words, the main valve 200 is moved upwardly by the operation lever 150, and in this instance, the first thermoelectric couple 240 generates the electromotive force by the flame generated by the ignition device 600, and the first magnet 250 is operated by the first coil 255 to which the electromotive force is transferred, such that the first opening valve 220 is fixed at the upwardly moved position. Therefore, the inflow path G1 is opened to supply gas. Accordingly, it is preferable that the first opening valve 220 is made of a metallic material having magnetism so as to be attracted and fixed by the first magnet 250. Moreover, it is also preferable that the first cutoff plate 230 is made of a rubber material having elasticity in order to provide sealability when the inflow path G1 is blocked.

Furthermore, the main valve 200 may further include a first thermostat 260 disposed between the first thermoelectric couple 240 and the first coil 255.

As shown in FIGS. 3 and 4, the first thermostat 260 includes: a bimetal 261 transformed at the time of setting temperature and mounted to transfer temperature of the cooking container; an operation bar 262 slidably moving by the bimetal 261; and an earthing part 263 disconnected by the operation bar 262.

With the structure above, when the bulging bimetal 261 reaches 150° C. which is the setting temperature for overheat, it is transformed concavely, and the operation bar 262 is lowered by the transformation of the bimetal 261 so that the earthing part 263 drops down.

When the earthing part 263 is thus disconnected, the electromotive force generated by the first thermoelectric couple 240 is not transferred to the first coil 255, and it causes a loss of the function of the first magnet 250, so that the first opening valve 220 and the first cutoff plate 230 are moved downwardly and returned to their original (closing) positions by the second spring 225 so as to prevent opening of the inflow path G1.

Therefore, when the cooking container is overheated at, for instance, 150° C. by the first thermoelectric couple 240, the gas range prevents supply of gas so as to prevent an accident.

The auxiliary valve 300 includes: a second pin 310 upwardly sliding according to the operation of the operation lever 150 and returning to its original position by a third spring 315; a second opening valve 320 upwardly sliding according to the upward movement of the second pin 310 and returning to its original position by a fourth spring 325; a second cutoff plate 330 mounted for opening and closing the first connection path G3 according to the upward sliding of the second opening valve 320; a second thermoelectric couple 340 mounted near to flame generated by the ignition device 600 for generating an electromotive force by the flame; and a second magnet 350 being magnetized by a second coil 355 which receives the electromotive force generated by the second thermoelectric couple 340 and fixing the second opening valve 320 moving upwardly.

In other words, the auxiliary valve 300 is moved upwardly by the operation lever 150, and in this instance, the second thermoelectric couple 340 generates the electromotive force by the flame generated by the ignition device 600, and the second magnet 350 is operated by the second coil 355 to which the electromotive force is transferred, such that the second opening valve 320 is fixed at the upwardly moved position. Therefore, the first connection path G3 is opened to supply gas. Accordingly, it is preferable that the second opening valve 320 is made of a metallic material having magnetism so as to be attracted and fixed by the second magnet 350. Moreover, it is also preferable that the second cutoff plate 330 is made of a rubber material having elasticity in order to provide sealability when the first connection path G3 is blocked.

Furthermore, the auxiliary valve 300 may further include a second thermostat 360 disposed between the second thermoelectric couple 340 and the second coil.

Because the second thermostat 360 has the same structure as the first thermostat 260, its detailed description will be omitted. When the cooking container reaches the proper state (at temperature of, for instance, 105° C.), the gas range prevents gas supply through the first connection path G3 so as to supply gas less than 100 percent, for instance, 20 percent to 35 percent of gas only, through the second connection path G4.

In other words, when the cooking container reaches the proper temperature, the auxiliary valve blocks the first connection path G3 so as to supply 20 percent to 30 percent of gas through the second connection path G4, so that the gas range can let the rice stand after cooking or simmer beef bone soup for a long time.

The timer 400 sets time by the user's manipulation, and actuates the main valve 200 in order to close the inflow path G1 after the lapse of the setting time.

When the main valve 200 moves upward to open the gas flow path G, namely, the inflow path G1, the burner valve 500 opens the auxiliary flow path G5 so as to supply gas, and then, is returned to its original position by a fifth spring 525.

The ignition device 600 ignites spark when gas is supplied after the burner valve 500 is opened.

In the meantime, as shown in FIG. 5, the gas range further includes: a third connection path G6 disposed between the inflow path G1 and the outflow path G2; and a selection valve 700 for opening or closing the third connection path G6 by the user's manipulation.

The selection valve 700 is used to provide 100% of fire power by the user's selection, when the auxiliary valve 300 blocks the first connection path by the second thermostat 360 so as to supply just a small quantity of gas at the time of the proper temperature.

Such a selection valve 700 includes: a manipulation bar 710 for allowing the user to manipulate with the hand; a third cutoff plate 720 mounted for opening and closing the third connection path G6 by the user's manipulation of the manipulation bar 710; and a sixth spring 730 mounted on the upper portion of the third cutoff plate 720 for returning the cutoff plate 720 to its original position.

Furthermore, as shown in FIG. 6, in order to simmer the ingredients to prepare stock by continuously supplying a weak fire power by hand power, the gas range may include: a press button 800 mounted on the front face of the gas range case K; and an ON-OFF switch 810 for, when it is on, intercepting the electromotive force generated from the second thermoelectric couple 340 and transferred to the second coil 355 by the user's manipulation of the press button 800, thus closing the second opening valve 320 of the auxiliary valve.

Referring to FIGS. 7 to 11, an operational state of a gas range operation controlling apparatus by thermo-sensitivity according to the present embodiment will be described in brief as follows.

First, after the cooking container is seated on the gas range, the user adjusts the timer and sets the operation time of the gas range by regulating the timer.

Figure 7:
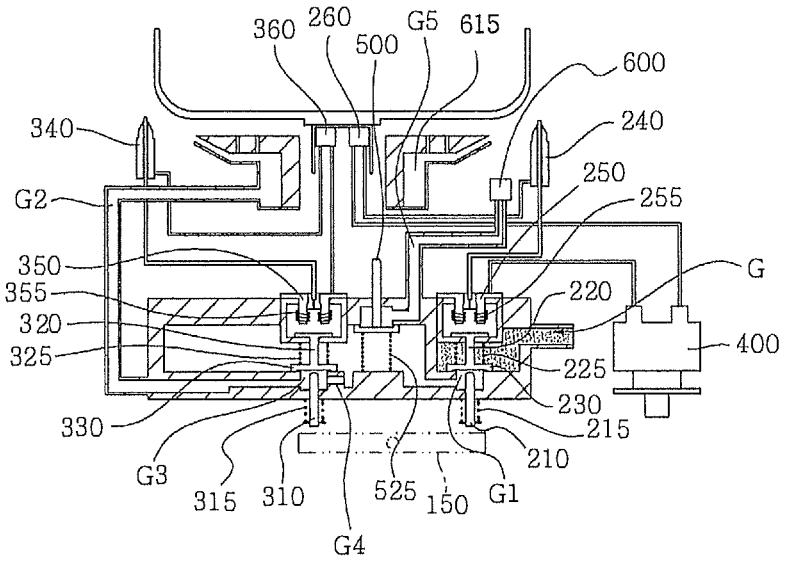
FIGS. 7 to 11 are schematic diagrams showing an operational state of the gas range according to the present invention.

After that, as shown in FIG. 7, the user opens the valve (not shown) of a gas pipe (not shown), so that gas is introduced into a part of the inflow path G1.

Figure 8:
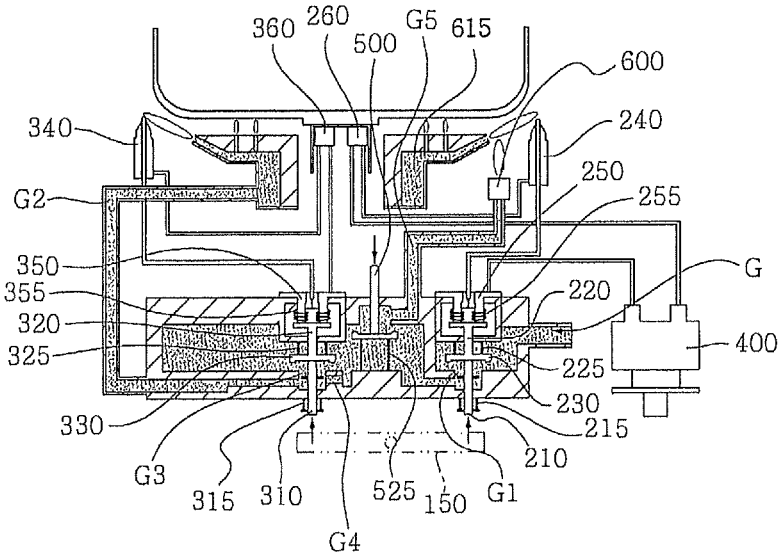

As shown in FIG. 8, when gas is introduced into the inflow path G1, the user opens the main valve 200 and the auxiliary valve 300 so as to supply gas to a heating part 615 of the gas range through the gas flow path G.

The burner valve 500 is opened at the same time with supply of gas to the heating part 615 of the gas range so as to supply a small quantity of gas through the auxiliary flow path G5, and then, the ignition device (or pilot burner) 600 is ignited so as to light the gas supplied through the gas flow path G. The lighting the gas via the ignition device 600 can be made by an electrode plug (not shown) connected to, for example, a piezo igniter (not shown) provided on the front face of the case of the gas range.

Figure 9:
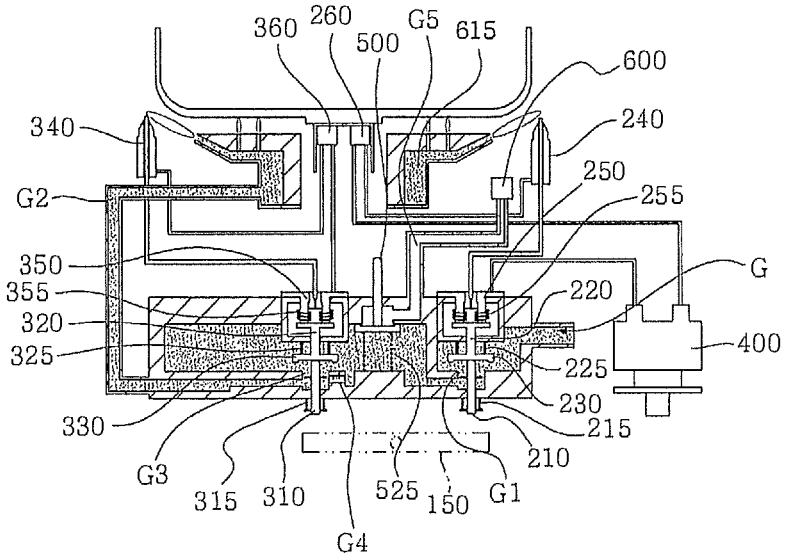

Continuously, when the gas range ignites spark, the burner of the range is lit and cooking starts using 1000 of the supplied gas as shown in FIG. 9 (see the gas flame figures in FIG. 9), and the burner valve 500 is closed by the fifth spring 525.

After a lapse of a predetermined time, when the cooking container reaches the proper temperature above 105° C. (for instance, 105° C.), as shown in FIG. 10, the second thermostat 360 is operated to intercept the electromotive force generated from the second thermoelectric couple 340, and hence, it causes a loss of the function of the second magnet 350, so that the second opening valve 320 and the second cutoff plate 330 of the auxiliary valve 300 are returned to their original (closing) positions.

Accordingly, the first connection path G3 is blocked, and less than 100 percent of gas, for instance, 20 percent to 35 percent of gas is supplied just through the second connection path G4 which is smaller in internal diameter than that of the path G3.

Figure 10:
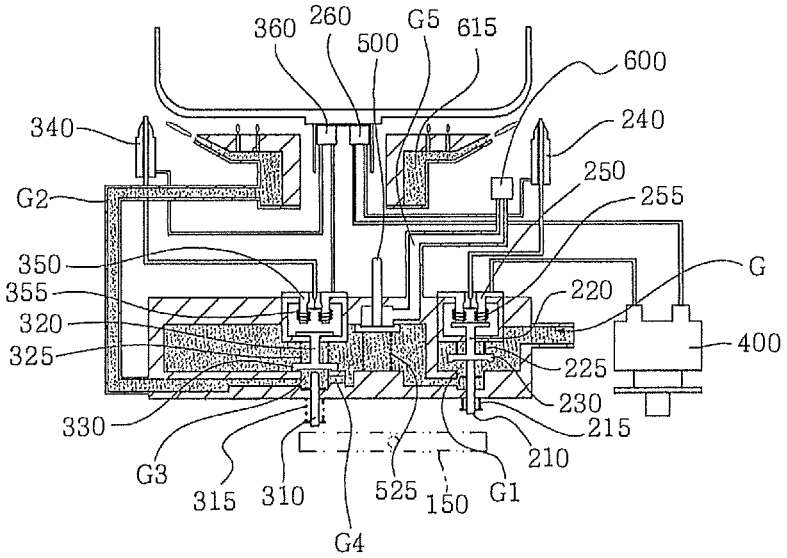

Therefore, the gas range according to the present invention can let the rice stand after cooking with the weak fire power (see smaller gas flame figures in FIG. 10).

Figure 11:
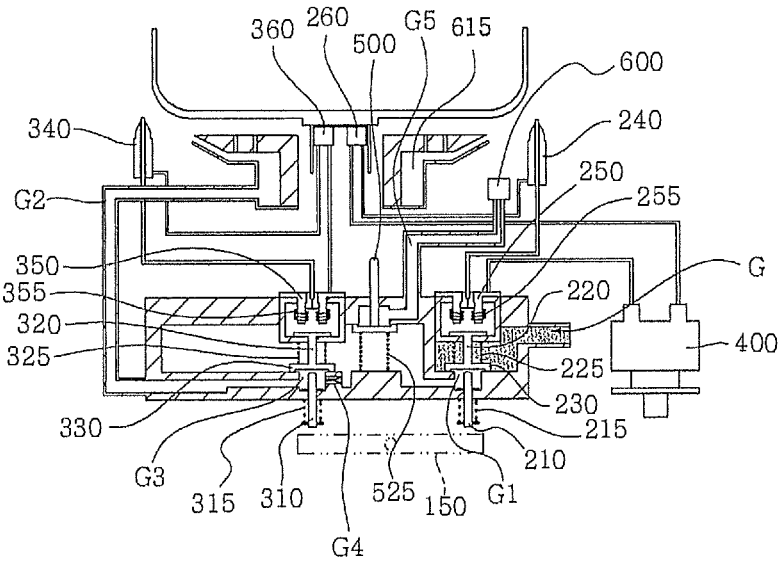

In the meantime, in the case that there is no moisture inside the cooking container, temperature of the cooking container rises. As shown in FIG. 11, when the cooking container is in the overheated state, namely, at temperature of 150° C., for instance, the first thermostat 260 is operated so as to intercept the electromotive force generated from the first thermoelectric couple 240, and hence, it causes a loss of the function of the first magnet 250, so that the first opening valve 220 and the first cutoff plate 230 of the main valve 200 are returned to their original (closing) positions.

Therefore, the inflow path G1 is blocked, and then, gas supply is stopped, securing the safety.

The main valve 200 is returned to its original position by the timer 400, namely, is returned to its original position by the timer 400 after a lapse of the setting time.

In the above-described operation, the gas control is made by the thermocouples, etc. However, in the present invention, as described above and shown in FIG. 6, the ON-OFF switch 810 can be provided in between the second thermostat 360 and the second magnet 350, and the ON-OFF switch 810 is manually controlled by the press button 800. Accordingly, when the ON-OFF switch 810 is turned on, the electromotive force generated by the second thermoelectric couple 360 and transferred to the second opening valve is blocked or intercepted, and thus the second opening valve 320 of the auxiliary valve is forced manually to close, and low temperature heating is performed. Thus, with the manipulation of the ON-OFF switch, the gas range can be manually used for a long-hour cooking that uses, for instance, a stock pot, etc. When the ON-OFF switch is turned off, the auxiliary valve works in the manner described in the previous paragraphs.

As described above, while the present invention is particularly described above with reference to the attached drawings, it will be understood by those of ordinary skill in the art that the present invention is not limited to the attached drawings and various changes can be made therein without departing from the technical idea of the present invention.

The invention claimed is:

1. A gas range used for cooking comprising:

a housing mounted inside a gas range case and having a gas flow path which includes an inflow path, an outflow path, first and second connection paths for connecting the inflow path and the outflow path with each other, and an auxiliary flow path;

an operation lever mounted on a front face of the case, configured to actuate a main valve and an auxiliary valve to supply gas through the gas flow path for cooking, and configured to operate a burner valve and an ignition device so as to ignite spark;

the main valve comprising:

a first pin configured to be moved by the operation lever and configured to be returned to its original position by a first spring;

a first opening valve configured to be moved by the first pin and configured to be returned to its original position by a second spring;

a first cutoff plate configured to move with the first opening valve to open and close the inflow path;

a first thermoelectric couple mounted near to flame for generating an electromotive force by the flame; and a first magnet configured to be magnetized by a first coil configured to receive electromotive force generated by the first thermoelectric couple and such that the first opening valve can be fixed at an upwardly moved position;

the auxiliary valve comprising:

a second pin configured to be moved by the operation lever and configured to be returned to its original position by a third spring;

a second opening valve configured to be moved by the second pin and configured to be returned to its original position by a fourth spring;

a second cutoff plate configured to move with the second opening valve to open and close the first connection path;

a second thermoelectric couple mounted near to flame for generating an electromotive force by the flame; and a second magnet configured to be magnetized by a second coil configured to receive electromotive force generated by the second thermoelectric couple such that the second opening valve can be fixed at an upwardly moved position;

a timer configured to operate the main valve to close the inflow path after a lapse of setting time;

the burner valve configured to open the auxiliary flow path so as to supply gas when the main valve moves to open the gas flow path and returning configured to return to its original position by a fifth spring; and the ignition device adapted to generate ignition spark when the burner valve is opened to supply gas.

2. The gas range according to claim 1, wherein the main valve further comprises a first thermostat disposed between the first thermoelectric couple and the first coil, the first thermostat configured to intercept an electromotive force when the cooking container reaches overheated temperature, so that the main valve returns to its original position in order to prevent gas supply.

3. The gas range according to claim 1, wherein the auxiliary valve further comprises a second thermostat disposed between the second thermoelectric couple and the second coil, the second thermostat configured to intercept an electromotive force when the cooking container reaches above 100° C., so that the auxiliary valve returns to its original position in order to prevent gas supply through the first connection path and less than 100 percent of gas is supplied through the second connection path.

4. The gas range according to claim 1, further comprising:

a third connection path disposed between the inflow path and the outflow path; and a selection valve configured to open and close the third connection path.

5. The gas range according to claim 4, wherein the selection valve comprises:

a manipulation bar;

a third cutoff plate mounted and configured to open and close the third connection path via the manipulation bar; and a sixth spring mounted on an upper portion of the third cutoff plate and configured to return the third cutoff plate to its original position.

6. The gas range according to claim 1, further comprising:

a press button mounted on the front face of the gas range case; and an ON-OFF switch configured to intercept the electromotive force generated from the second thermoelectric couple and transferred to the second coil via the press button.

* * * * *